United States Patent [19]

Baggio et al.

[11] Patent Number: 4,526,596

[45] Date of Patent: Jul. 2, 1985

[54] PROCESS FOR RECOVERING BUTANE AND PROPANE FROM CRUDE GAS

[75] Inventors: Jean-Louis Baggio, Tremblay les Gonesse; Patrice Saintherant, Meudon, both of France

[73] Assignee: Compagnie Francaise des Petroles, Paris, France

[21] Appl. No.: 437,727

[22] Filed: Oct. 29, 1982

Related U.S. Application Data

[63] Continuation of Ser. No. 250,788, Apr. 3, 1981, abandoned.

[30] Foreign Application Priority Data

Apr. 4, 1980 [FR] France ..... 80 07685

[51] Int. Cl.[3] ..... F25J 1/02

[52] U.S. Cl. ..... 62/40; 62/335

[58] Field of Search ..... 62/40, 9, 11, 335

[56] References Cited

U.S. PATENT DOCUMENTS 4,094,655 6/1975 Krieger ..... 62/40

*Primary Examiner*—Frank Sever

*Attorney, Agent, or Firm*—Sughrue, Mion, Zinn, Macpeak & Seas

[57] ABSTRACT

In a process for recovering or fractionating a mixture composed mainly of butane and propane and present in a crude gas, using an external mechanical cooling loop, the mixture itself constitutes the cooling fluid in the loop and the loop comprises a compressor, a condenser, a storage tank and a heat exchanger in series.

17 Claims, 8 Drawing Figures

PROCESS FOR RECOVERING BUTANE AND PROPANE FROM CRUDE GAS

This is a continuation of application Ser. No. 250,788, filed Apr. 3, 1981, now abandoned.

BACKGROUND OF THE INVENTION

The invention relates to a cooling process for recovering and/or fractionating a mixture composed mainly of butane and propane, generally designated by the name NGL ("Natural Gas Liquid"), present in a crude gas, such as a gas associated with petroleum, a natural gas or condensate gas, which process uses an external mechanical loop through which a cooling fluid passes.

Apart from butane and propane, the NGL mixture may also contain lighter components, such as ethane, and heavier components, such as pentane and even hexane. Fractionation of the NGL mixture produces petroleum gases known by the name LPG ("Liquefied Petroleum Gases"), such as commercial propane and commercial butane.

Hitherto, the recovery and fractionation of an NGL mixture present in a crude gas, with an external mechanical cooling loop, has been carried out using a pure cooling fluid, such as, for example, Freon 12, ammonia or propane. Loops of this type, which are described, for example, in the 1972 edition of the publication of the NGPSA ("Natural Gas Processors Suppliers Association"), section 5, FIGS. 5-14 and 5-15, and in "World Oil" of September 1961, pages 83 to 96, have the disadvantage of limiting the possibilities of recovery or fractionation of the gases to be treated, because of the very nature of the cooling fluid used; for example, propane does not make it possible to fall below −35° C. These loops thus lack flexibility and are difficult to adapt as soon as the actual conditions of the gas to be treated tend to deviate from the base conditions.

Admittedly, it is possible to increase the amount of NGL mixture produced, by installing a second cooling loop through which a more volatile cooling fluid than the first passes, and which makes it possible to produce a further lowering of the temperature of the gas to be treated. However, this results in an expensive proliferation of the equipment installed.

Furthermore, in the case where the plant for recovering and/or fractionating the NGL mixture is located in a desert region or a region which is a long way from any source of supply of pure cooling fluid, it can result in problems regarding the supply of coolant and hence in a reduction, or even a halt, in the production of the plant.

One method providing a possible alternative to the use of an external mechanical cooling loop consists in installing an expansion turbine acting on the gas from which it is desired to extract the NGL mixture or the LPGs. However, this method is only industrially practicable if the pressure of the gas to be treated is sufficiently high and if the quality of the gas to be treated undergoes little or no variation throughout the operating life of the plant. If this is not the case, it is necessary to add an external mechanical cooling loop.

The invention relates to a cooling process using an external mechanical loop through which a cooling fluid passes, for recovering and/or fractionating an NGL mixture present in a crude gas, which provides this loop with a high degree of flexibility of use, both in the range of temperatures which can be reached and in the independence of its operation in relation to external supply sources.

According to the invention the mixture itself, composed mainly of butane and propane, referred to as NGL, extracted from a crude gas, forms the cooling fluid of the external mechanical loop which is required for the production and/or fractionation of this NGL mixture.

As stated above, the NGL mixture produced from a crude gas contains ethane, propane, butane and a few slightly heavier hydrocarbons, such as pentane and even hexane. This ethane content ensures that the b.p., at atmospheric pressure, of the NGL mixture is generally lower than that of the cooling fluids ordinarily used (for example pure propane). This has the main advantage of permitting a greater lowering of the temperature of the gases to be treated.

Furthermore, the mechanical cooling loop through which a fluid of this type passes does not require an auxiliary supply, outside of the plant for production of NGL and/or LPG, in order to compensate the losses during normal operation of the plant. If, as is generally the case, the plant is equipped with a stock of NGL mixture, an appropriate cooling fluid is then immediately available for bringing the plant back on stream after a normal or unforeseen shutdown. Only the first start-up of a plant for the production of NGL requires an external supply either of NGL mixture of a quality similar to that of the NGL mixture to be produced, or of propane to which some crude gas is added, provided that it is treated in order to remove the moisture and the corrosive components therefrom.

The additional flexibility in the operation of a plant for the production of NGL mixture should also be noted, this flexibility being obtained by the use of a cooling fluid of this type in an external mechanical cooling loop; in fact, the degree of recovery, from the crude gas, of the NGL mixture produced by the plant is directly related to the temperature obtained with the aid of the cooling loop; now, with the process according to the invention, this temperature is a characteristic of the quality of the NGL mixture produced and hence of the recovery.

The process according to the invention makes it possible to improve the performances of an existing plant for recovering the NGL mixture, of which it is desired to increase production by recovering the additional NGL mixture still present in the already treated gas leaving the plant. Since the existing external mechanical cooling loop does not permit this increase in production, as a result of the low-temperature limitation of the pure cooling fluid which passes through this existing loop, it is necessary to install a second mechanical loop which uses a more volatile, pure cooling fluid than the one already in use. Apart from exceptional cases, where it will be possible to pass the NGL mixture produced through the existing loop, the invention will not dispense with the installation of this second loop, but it will provide the latter with significant advantages by passing through it the NGL mixture produced by the plant, instead of a pure cooling fluid. On the one hand, the cooling fluid of the second loop is thus immediately available on site, without it being necessary to obtain an external supply of a pure cooling fluid, such as, for example, ethane. On the other hand, the fluid used to condense the NGL mixture in the second mechanical loop will be the same as that used to condense the pure cooling fluid in the existing loop, that is to say air or water. Interdependence between the two loops of a cascade of the propane-ethane type, for example, in which the ethane must be condensed with propane, therefore no longer exists. This results in a reduction in the installation costs, the financing expenses and also the size of the equipment to be installed. If appropriate off-takes are provided on the heat exchangers for the gas to be treated, the two cooling loops can furthermore be used to back each other up.

The invention also applies to the production of liquefied natural gas (LNG) with the use of several external mechanical cooling loops (propane loop, ethane or ethylene loop and methane loop, in the case of a conventional so-called cascade system). It will be possible, for example, to replace the propane loop, or both the propane loop and the ethane or ethylene loop, by an NGL loop according to the invention.

BRIEF DESCRIPTION OF THE DRAWINGS

Numerous characteristics of the invention, relating especially to auxiliary supplies, supercooling, and removal effected from the NGL loop in order to increase its flexibility of use, will become apparent from the description of embodiments which will be given with reference to the attached schematic drawings, in which.

DETAILED DESCRIPTION OF THE PREFERRED EMBODIMENTS

Figure 1:
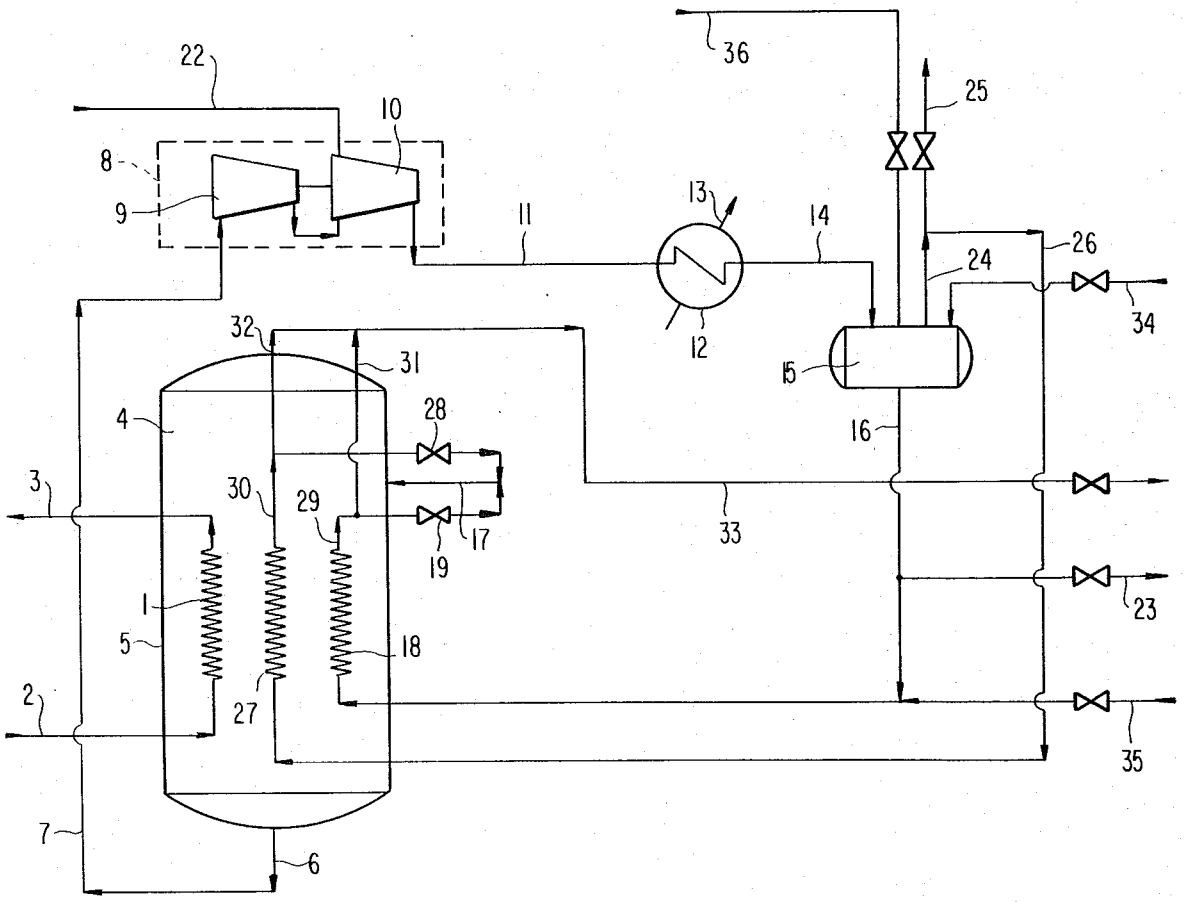
FIG. 1 is a diagram of an embodiment of a cooling circuit according to the invention, in which the NGL mixture produced by the plant and compensating the losses of the cooling loop is supplied in the form of a gas.

In FIG. 1, the cooling needs of a plant, which is not shown, for recovering NGL mixture from a crude gas and/or fractionating this mixture in order to produce LPGs have been represented by a bundle of tubes 1 through which a fluid to be cooled passes, the said fluid entering at inlet 2 and leaving at outlet 3. In reality, according to requirements, there can be several bundles or passages through which different fluids pass, such as, for example, fluids to be treated or auxiliary absorption fluids. This bundle 1 constitutes one element of a heat exchanger 4 of the indirect surface contact type, for example of the T.E.M.A. type, of the coil type or of the plate type. A cooling fluid, which is an NGL mixture produced by the plant and hence available in the latter, is supplied to the space inside the envelope 5 of the exchanger 4 and vaporises in this space.

This NGL mixture leaves the heat exchanger 4 at outlet 6 and is supplied, via a pipeline 7, to a compressor 8 with two stages, namely an upstream stage 9 and a downstream stage 10, which it leaves via a pipeline 11 and partially or totally condenses in a condenser 12 of the indirect surface contact type, cooled by a stream of air or water 13. A pipeline 14 connects the outlet of the condenser 12 to the inlet of a storage tank 15 from which a liquid output 16 returns to the heat exchanger 4 and vaporises therein. The inlet pipe for feeding the NGL mixture into the heat exchanger 4 is shown at 17. It is seen that the oulet 16 is not connected to this inlet directly, but via a bundle of tubes or passage 18 and a lagged control valve 19, where the mixture expands. This bundle of tubes 18 makes it possible to supercool the NGL mixture before it enters, at 17, the space inside the envelope 5, where it acts as a coolant by vaporising therein.

If the cooling fluid leaving the heat exchanger 4 at outlet 6 is not entirely vaporised, it is possible for the fluid, before being supplied to the inlet of the stage 9 of the compressor 8, to provide, by vaporising, part of the cooling which can be provided between the stages 9 and 10 of the compressor 8, and/or part of the final desuperheating of the fluid leaving the compressor 8. This cooling between the compressor stages and this final desuperheating have not been shown in FIG. 1.

Figure 2:
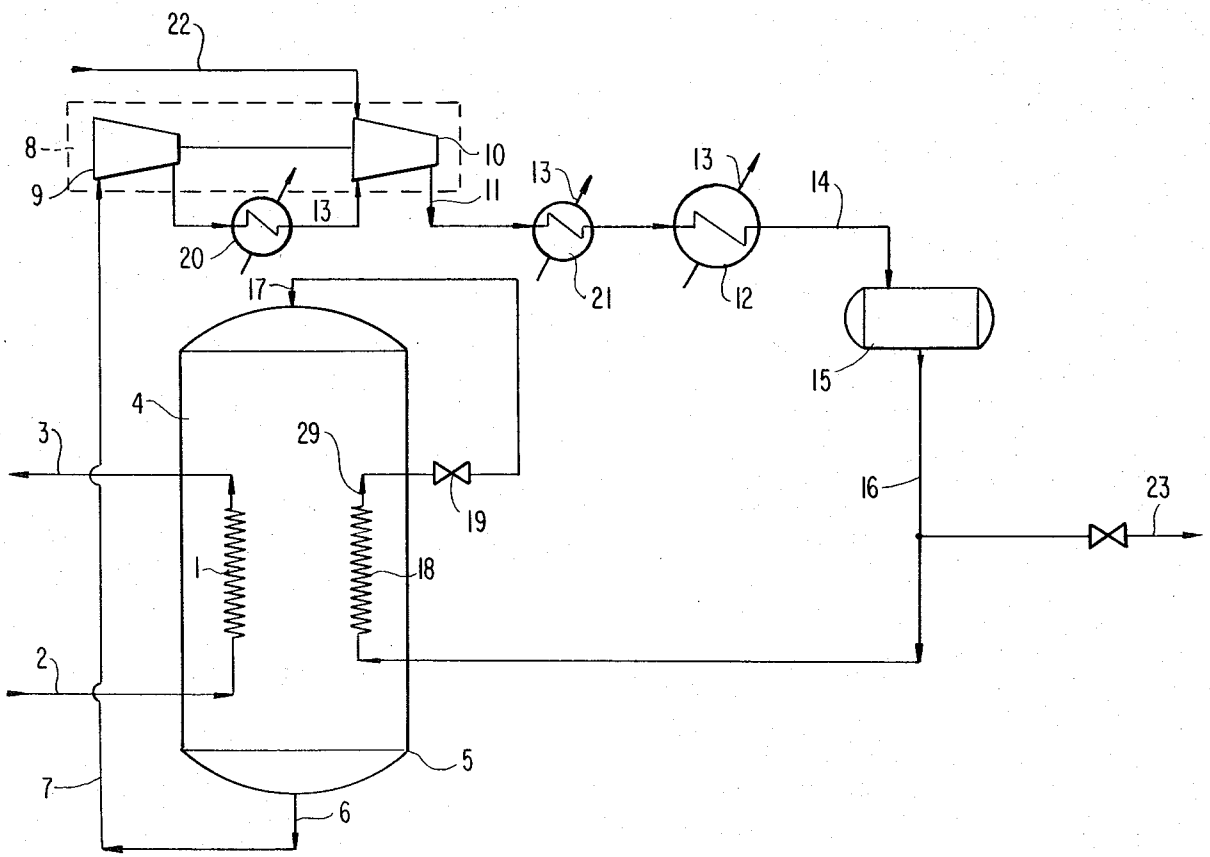
FIG. 2 is an analogous diagram of another embodiment in which there is total condensation of the NGL mixture from the loop in the condenser of the latter.
Figure 6:
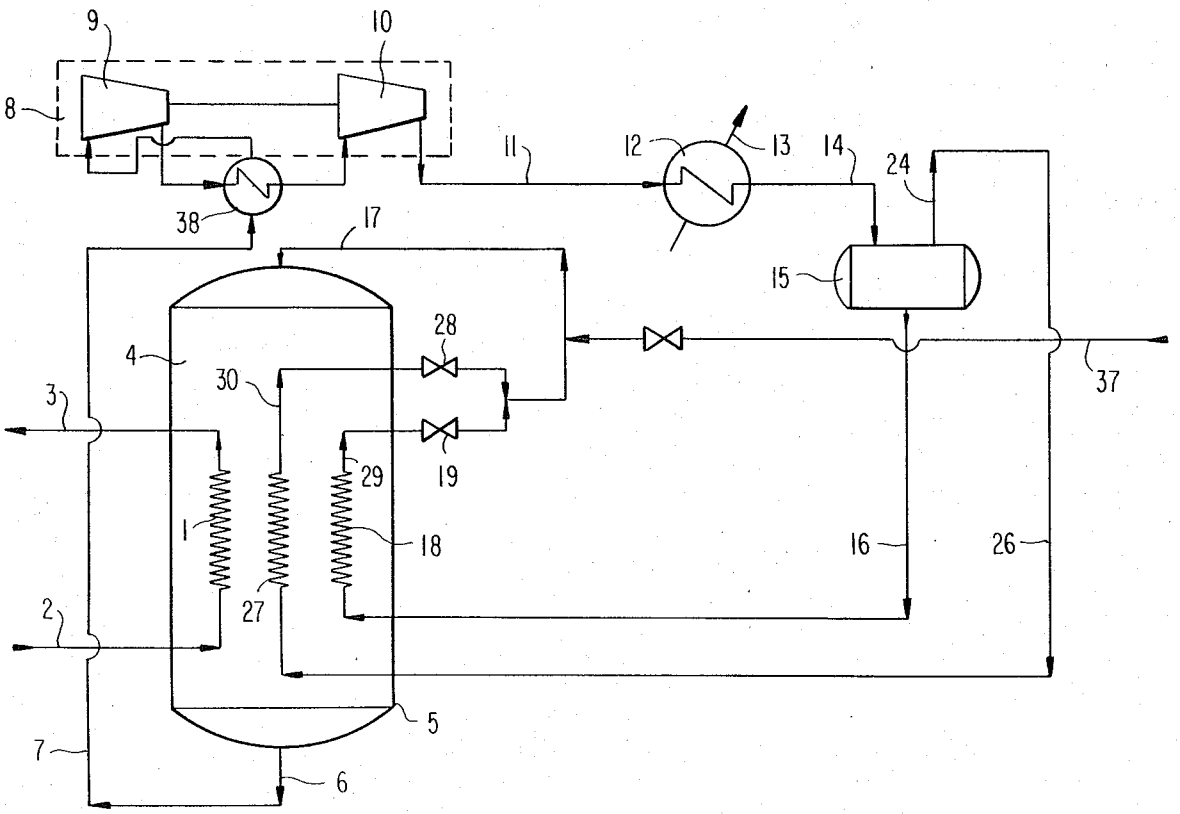
FIG. 6 is a diagram of a further embodiment of a cooling circuit according to the invention, in which the NGL mixture produced by the plant and compensating the losses of the cooling loop is supplied in the form of a liquid.

In the embodiment of FIG. 2 this cooling is carried out solely by air coolers 20 and 21 receiving a stream of air 13, but it could equally well be provided partly by the fluid leaving the exchanger 4 at outlet 6 and partly by a flow of air or water. In the embodiment of FIG. 6 cooling between the compressor stages is effected in cooler 38 using the NGL fluid from the heat exchanger. The cooling between stages must not cause partial condensation of the NGL mixture at its existing pressure. The NGL mixture will thus be cooled to a temperature which is a few degrees centrigrade higher than its hydrocarbon dew point at the outlet pressure of the upstream stage 9.

The stage 10 of the compressor 8 compresses the NGL mixture to an absolute pressure of between 13 and 27 bars.

In the embodiment of FIG. 1, the NGL mixture produced by the plant is available in the form of a vapour, originating, for example, from the treatment of a crude gas by oil absorption. It is thus introduced into the cooling loop, comprising the compressor 8, the condenser 12, the storage tank 15 and the exchanger 4, upstream of the condenser 12, and, as its pressure is less than the delivery pressure of the compressor 8, it enters the downstream stage 10 of the compressor 8 via an inlet pipe 22, the first stage 9 of the compressor bringing the NGL mixture from the loop, originating from the pipeline 7, to a pressure which is approximately equal to that of the auxiliary supply of NGL mixture via the pipe 22. If the condensation pressure of the NGL mixture which is compatible with the condensation fluid (air or water) used in the condener 12 is not greater than the pressure of the NGL mixture available in the inlet pipe 22, only the NGL mixture originating from the pipeline 7 passes through the compressor 8 and the latter can be reduced to a single stage, the inlet pipe 22 being connected between the compressor 8 and the condenser 12.

The inlet pipe 22 makes it possible to compensate for losses of NGL mixture which occur in the coolingfluid loop 8, 12, 15, 4. It is also possible to make provision for using part of this loop for subjecting the NGL mixture produced by the plant to the preliminary condensation required for its storage and/or its fractionation. An off-take 23 is then provided in the liquid outlet 16 and is connected to devices for uncooled storage and/or fractionation installations, which devices and installations have not been shown. Thus, both a cooling NGL mixture passing through the remainder of the loop, and an NGL mixture constituting the production of the plant, the latter mixture being withdrawn at off-take 23 for storage and/or fractionation purposes, are conveyed in the portion 10, 12 and 15 of the loop.

The condensation of the NGL mixture is partial or total according to the pressure of the storage tank 15 (or the delivery pressure of the compressor 8), taking into account the fact that it is not possible to influence the condensation temperature in the condenser 12. An increase in the delivery pressure of the compressor 8 results in a reduction in the amount of vapour from the storage tank 15 to be condensed and to be supercooled in the exchanger 4, and hence in a reduction in the flow rate of cooling fluid in the loop; on the other hand, this tends to increase the compression ratio of the compressor and hence its power. This pressure is therefore to be optimised as a function of the quality of the desired NGL and of the ambient cooling means (air or water) available to the plant. If the condensation is total, the cooling loop can be simplified and can be limited to the elements described above, as shown in FIG. 2.

In the case where the storage tank 15 receives a partially condensed NGL mixture, it is advantageous to provide a purge 25 for the volatile components present in the NGL mixture. A concentration of light components in the cooling circuit is thus avoided and a large part of the volatile components present in the NGL mixture leaving at off-take 23 is removed from the said mixture, which relieves the possible fractionation installations to which the off-take 23 is connected. The device also makes it possible to lower the quality of the cooling fluid and hence to modify the quality and the amount of NGL mixture produced by the plant (for example to reduce its ethane content). The purge 25 can lead to the inlet of the plant or to a fractionation column, such as, for example, a demethaniser or a deethaniser. An outlet for volatile components has been provided, which branches off this purge 25 and also off a pipe 26 which rejoins the inlet pipe 17 in the exchanger 4 after having passed through a bundle of tubes or passage 27, provided in the exchanger 4, where the volatile components of the NGL mixture condense and are supercooled, and after passing through a lagged control valve 28, where they expand.

The final temperature of the fluids leaving the bundles 18 and 27 at 29 and 30 respectively is approximately the same and it is adapted so that, after expansion in the valves 19 and 28 and mixing of the flows leaving the latter, an NGL mixture close to its b.p. at the pressure prevailing in the inlet pipe 17 is re-formed in the inlet pipe 17. The temperature of the fluid flowing from the inlet pipe 17 should be at least 4° C. below those of the fluids at the outlets 29 and 30. It is clear that the pressure of the NGL mixture from the loop in the inlet pipe 17 is adapted to the cooling requirements of the plant, which are represented schematically by the bundle of tubes 1, the NGL mixture from the loop, which is virtually condensed in the pipe 17, vaporising in the heat exchanger 4 in order to ensure both the cooling needs of the plant (1) and the cooling needs of the NGL mixture in the bundles 18 and 27. The temperatures of the fluid or fluids at the outlet 3 are at least equal to the temperatures of the fluids at the outlets 29 and 30.

NGL mixture produced can be drawn off at low temperature at the outlets 29 and 30 by means of off-takes 31 and 32 terminating in an outlet pipe 33 connected, for example, to a storage unit for cooled NGL mixture, which is not shown. The temperature of the fluids circulating in the outlets 29 and 30 is such that the NGL mixture produced, which is circulating in the outlet pipe 33 and must be expanded in the storage unit, will again be at its b.p. at the storage pressure, this pressure being similar to the pressure prevailing in the inlet pipe 17.

It has already been stated that the losses of NGL mixture occurring in the cooling loop 8, 12, 15, 4, which losses are at most of the order of 0.01% of the flow rate of NGL mixture circulating in the loop under normal operation, can be compensated by an auxiliary supply of cooling fluid introduced into the inlet pipe 22. It is also possible to introduce, into the storage tank 15, via an inlet pipe 34, NGL mixture produced which is under pressure and has been taken from an uncooled storage unit under pressure, if such a storage unit exists. Likewise, an inlet pipe 35, connected to the outlet pipeline 16 of the storage tank, makes it possible to introduce an auxiliary supply of NGL mixture taken from a cooled storage unit at low pressure, if such a storage unit exists.

In the case where the plant is brought back on stream after normal or unforeseen shutdown, an NGL mixture produced and previously stored can be used to fill the cooling loop through the pipes 34 and/or 35, depending on the characteristics of the storage units of the plant.

It is also possible to modify the quality of the NGL mixture passing through the loop by introducing light components into the storage tank 15 via an inlet pipe 36. These light components are available especially if the plant comprises units producing light components from the crude gas, as is the case of a plant for recovering NGL mixture by cooled oil absorption. By modifying the quality of the NGL mixture passing through the loop, the cooling loop is caused to change and the quality and quantity of NGL mixture produced are thus caused to vary. This possibility of introducing light components is particularly important in the case of total condensation of the NGL mixture in the storage tank 15. It is clear that, in the case of partial condensation of the NGL mixture from the loop in the storage tank 15, this possibility is in addition to that of varying the quality of the cooling fluid by acting on the purge 25.

Taking account of the possible variations in quality and pressure of the cooling fluid leaving the exchanger 4 at 6, the compressor 8 is provided with devices making it possible to accept these variations (fixed blading with directional suction, recycling systems or any system of conventional design).

FIG. 1 shows a certain number of valves, but it will be understood that the determination of the various parameters, and especially of the temperature and pressures of the cooling loop, requires an entire regulating system. This system has not been shown here because it is of conventional design and does not form part of the actual invention.

Figure 3:
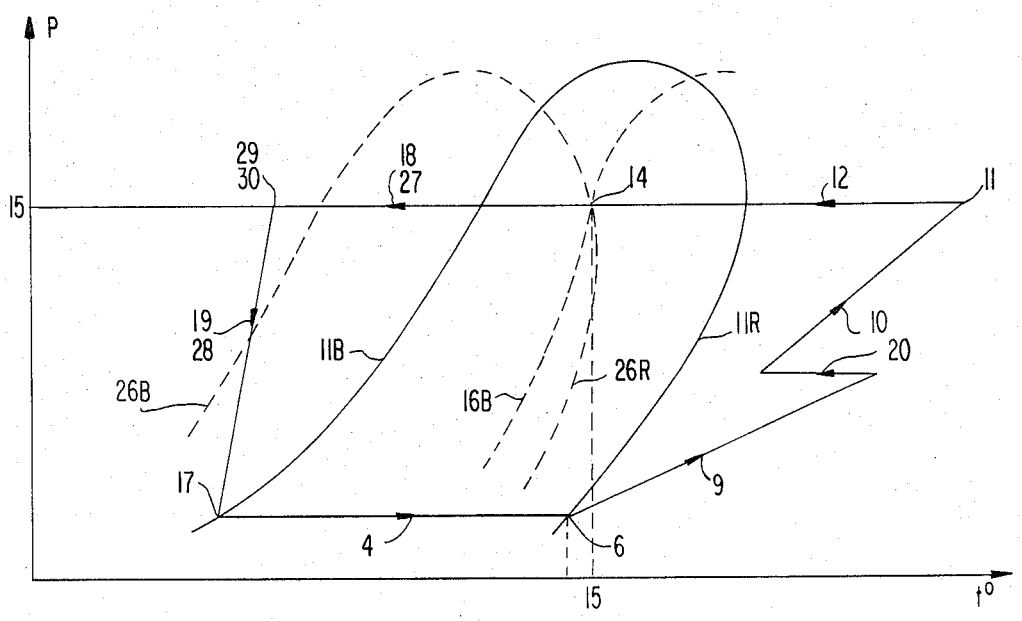
FIGS. 3 and 4 show pressure/temperature graphs of the mechanical cooling cycle, corresponding respectively to the case where the condensation of the NGL in the condenser is partial and to the case where it is total.
Figure 4:
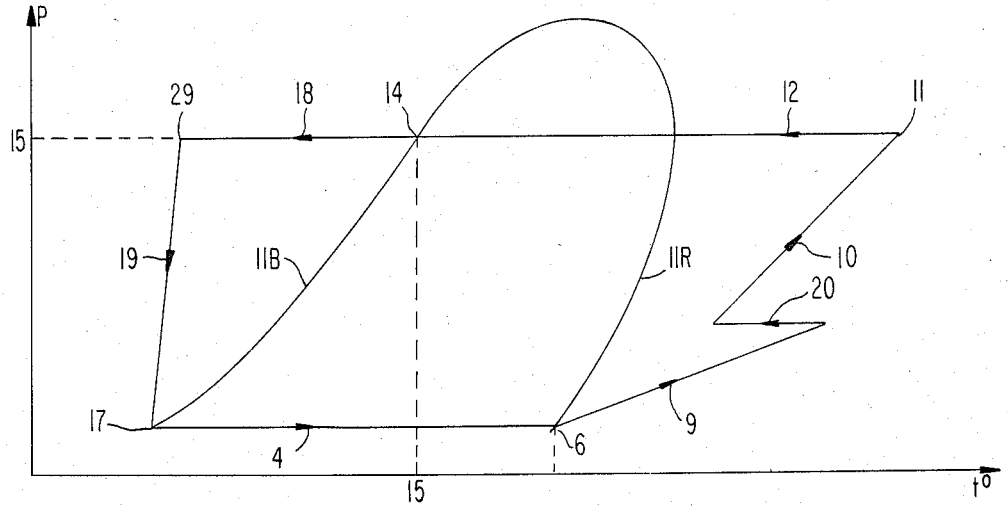

FIGS. 3 and 4 show the graph of the mechanical cooling cycle, the pressure P being plotted on the ordinate and the temperature t° on the abscissa. The graph of FIG. 3, which corresponds to the case of partial condensation at 12, also shows the hydrocarbon dew-point curve 11 R of the mixture circulating in the pipeline 11 at the outlet of the compressor, the b.p. curve 16 B and the hydrocarbon dew-point curve 26 R of the mixture leaving the storage tank 15 via the pipeline 26, and the b.p. curve 16 B of the mixture leaving the storage tank 15 at 16. Between the b.p. curve and dew-point curve of one and the same mixture, the latter is in a two-phase state, namely in the form of liquid and vapour. In FIG. 4, which corresponds to the case of total condensation at 12, this being the case of the loop of FIG. 2, the graph shows only the b.p. curve 11 B and the hydrocarbon dew-point curve 11 R of the mixture circulating in the pipeline 11.

The mechanical cooling cycle can easily be followed on these graphs, which indicate the reference number of the apparatus in which a conversion takes place and the reference number of the points reached: starting from the outlet 6, compressions 9 and 10, with intermediate cooling 20, to reach the pipeline 11; partial or total condensation 12 to reach the pipeline 14; supercooling 18 or 18 and 27 to reach the outlet 29 of the bundle 18 or the outlets 29 and 30 of the bundles 18 and 27; expansion 19 or 19 and 28 to reach the inlet pipe 17; and vaporisation 4 to return to the outlet 6. It is seen that the flow in the pipeline 14 is in a two-phase zone in FIG. 3, whereas, in FIG. 4, it corresponds to complete condensation.

The quality of an NGL mixture produced by recovery from a crude gas cooled to −38° C. by a cooling fluid of the same quality as the NGL mixture produced, in a process based on absorption by a stabilised oil, can be, for example, as follows:

ethane: 5.27 mol %
propane: 81.22 mole %
butanes: 11.00 mole %
pentanes: 2.51 mol %

Figure 5:
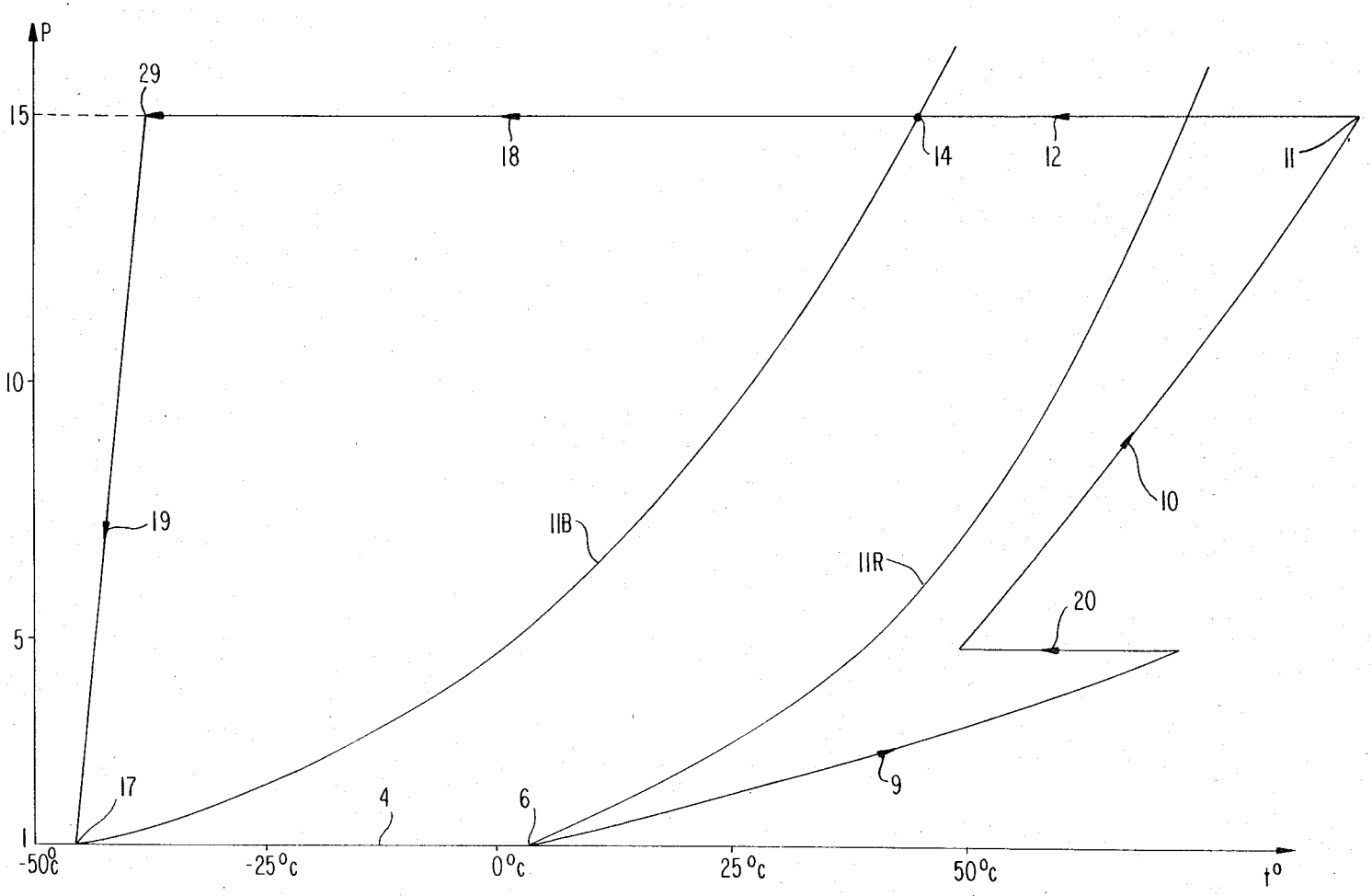
FIG. 5 shows a pressure/temperature graph for a particular NGL mixture passing through the loop of FIG. 2.

FIG. 5 shows a graph corresponding to a mixture of this type, and gives temperature values in degrees centigrade and absolute pressure values in bars.

A process such as the simple mechanical cooling of a gas can result in the production of an NGL mixture in the form of a liquid, which is available, for example, at the outlet of a cold separator. The quality of an NGL obtained from a process of this type includes a wider range of components (higher concentration of ethane) than that obtained by a process of the oil absorption type.

FIG. 6 illustrates an embodiment of a loop in which the loop is supplied with NGL mixture, produced or available in the plant, in the form of a liquid. The NGL mixture introduced does not therefore have to be condensed first; in particular, it can be introduced directly into the inlet pipe 17 of the exchanger 4 via a pipeline 37, and it simply serves as an auxiliary supply for compensating the losses of the cooling fluid in the loop or as a supply when the plant is brought back on stream after a normal or unforeseen shutdown.

The NGL mixture introduced via the pipeline 37 is taken, for example, from the liquid effluent of a cold separator of the plant, which is an apparatus which collects the NGL mixture recovered from the crude gas of the plant, or of any other separator located downstream of the one designated above, but, in any case, before a possible stabilisation or deethanisation of the NGL mixture (the purpose of which would be to top the NGL mixture, that is to say to separate therefrom the light components present therein).

In FIG. 6, the same reference numbers as above have been retained for denoting members analogous to those of FIGS. 1 and 2.

In the embodiment shown, it has been assumed that the NGL mixture from the loop is not completely vaporised when it leaves the heat exchanger 4 at 6, and provision has been made to vaporise the remaining liquid by passing it into an apparatus 38 for cooling the flow of cooling fluid running between the stages 9 and 10 of the compressor 8.

The quality of an NGL mixture produced by the simple cooling of a crude gas to −28° C. by means of an external mechanical loop through which the NGL mixture passes can be as follows:

methane: 6.3 mol %
ethane: 13.61 mol %
propane: 29.27 mol %
butanes: 29.71 mol %
pentanes: 13.89 mol %
hexanes: 6.15 mol %
inert components: 1.00 mol %

Figure 7:
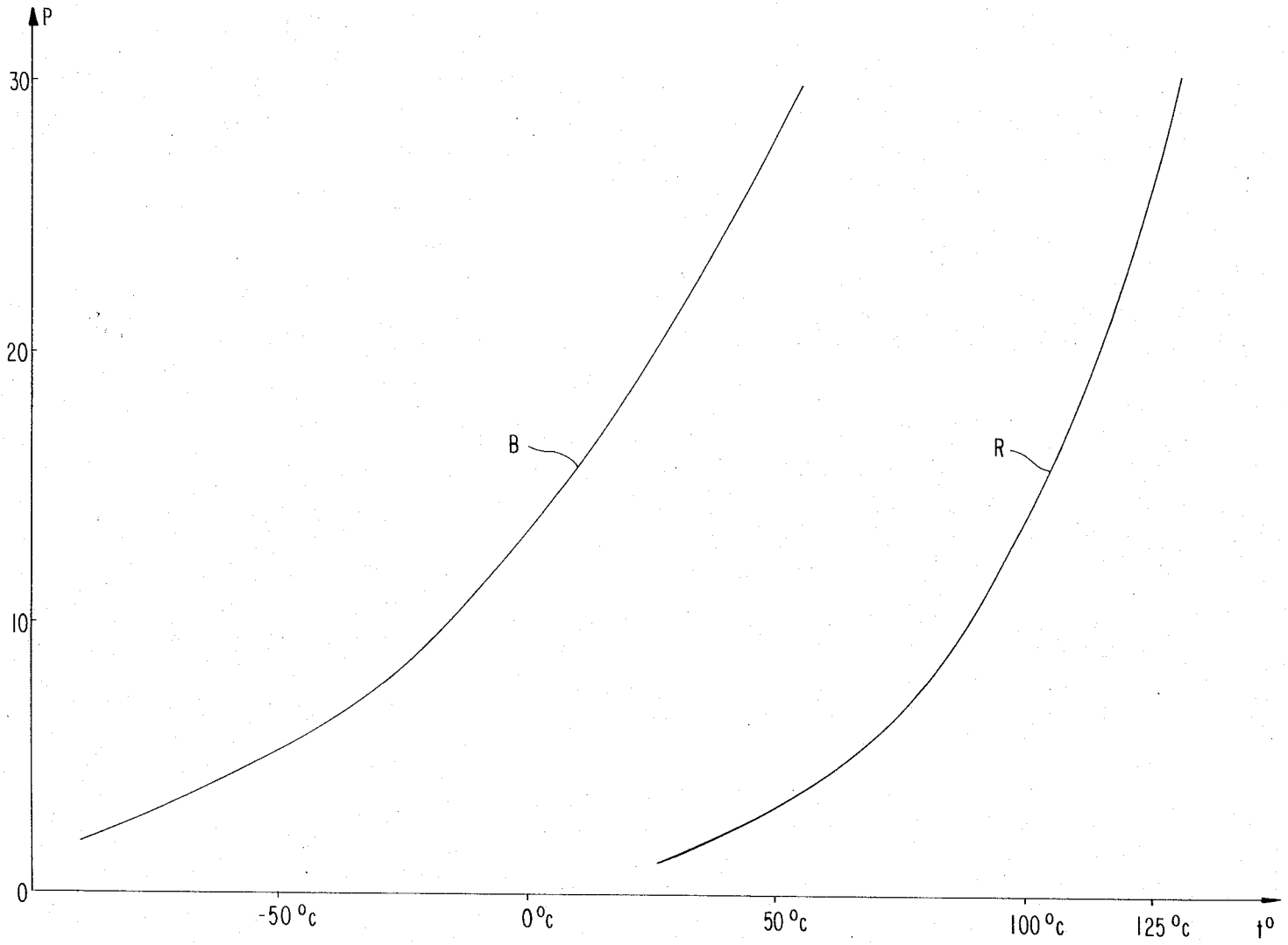
FIG. 7 shows a pressure/temperature graph for a particular NGL mixture available in the form of a liquid.

FIG. 7 shows the graph of the phases of a product of this type, B being the b.p. curve and R the hydrocarbon dew-point curve, and the temperatures t° being expressed in degrees centigrade and the absolute pressures in bars. The shape of the b.p. curve B shows that the NGL mixture is an excellent cooling fluid. It is possible, for example, to record −35° C. under an absolute pressure of 7 bars and −45° C. under an absolute pressure of 26 bars, which enables the operating pressures of a possible cooling loss to be defined.

Figure 8:
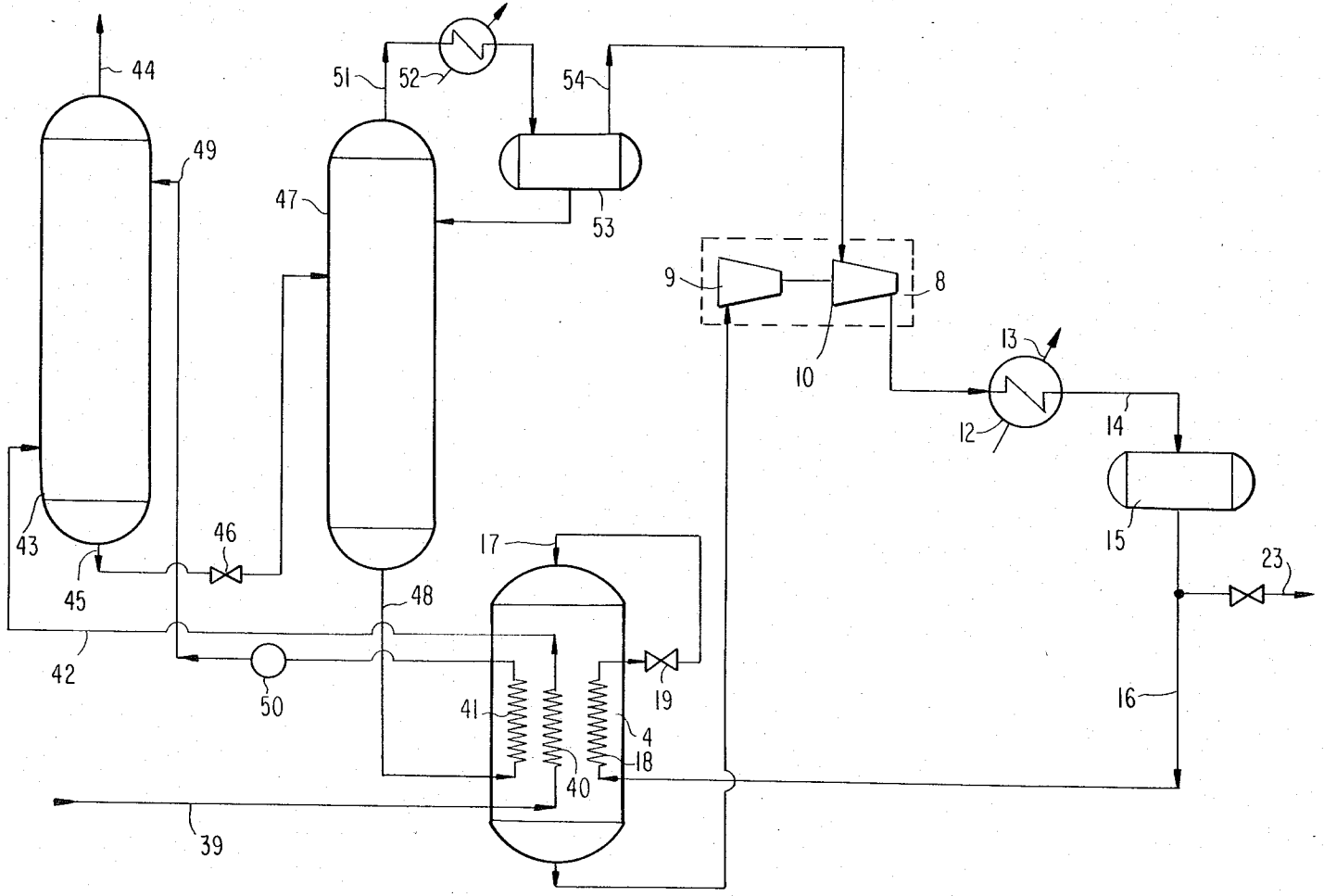
FIG. 8 is a diagram of the application of the invention to a plant for recovering an NGL mixture from a crude gas.

FIG. 8 shows a simplified diagram of the application of the invention to a plant for recovering an NGL mixture from a crude gas arriving via a pipe 39.

This figure again shows the majority of the elements of the diagram of FIG. 2, with the same references, but the bundle of tubes 1, represented very schematically, has been replaced by two bundles of tubes 40 and 41.

The crude gas arriving via the pipe 39 is initially cooled in the bundle of tubes 40 before entering an oil abosrber 43 via the pipe 42. The nonabsorbed gas leaves at 44, whilst the oil/absorbed gas mixture leaves at 45 and, after expansion in a valve 46, passes into an oil regenerator 47, from which the regenerated oil leaving at 48 passes into the bundle of tubes 41 before being reintroduced into the oil absorber 43 at 49, via a pump 50. The mixture leaving the column head of the regenerator 47 at 51 passes into a heat exchanger 52, which can be an air cooler or a water cooler, and then into a flow-back tank 53, from which an NGL mixture leaves at 54, entering the downstream stage 10 of the compressor 8. A very small part of this NGL mixture serves to compensate the losses of the mechanical loop 8, 12, 15, 4, whilst virtually all of this mixture, available at 23, constitutes the production of the plant and proceeds to storage installations, which are not shown.

Of course, production and storage of cooled NGL mixture could also be provided, it being possible for the various arrangements described above to be adopted in whole or in part, and it being possible, in particular, to provide an outlet such as 33.

The arrangement wherein the NGL mixture recovered at 54 then passes through a portion (for example 10, 12, 15 or 10, 12, 15, 18, 27) of the external mechanical loop, the whole of which is used for cooling operations necessary for this recovery, in order to make this recovered NGL mixture available in a suitable form (for example 23 or 33), in particular for the purposes of storage or fractionation, constitutes an important characteristic of the invention.

All the embodiments of the invention which have been given do not of course imply a limitation, multiple variants making it possible to adapt the cooling loop in the best possible way to the various characteristics of the cases in which it is applied.

We claim:

1. A cooling process, comprising; cooling a fluid flow for recovering or fractionating an NGL mixture including substantial portions of butane and propane and present in a crude gas with a closed cooling loop which includes a mechanical cycle by passing a coolant through said loop substantially flow-isolated from said fluid flow, said coolant consisting primarily of said NGL mixture.

2. The process according to claim 1, wherein said loop comprises, in succession, a compressor, a condenser, a storage tank having a liquid outlet, and a heat exchanger, and further including an auxiliary supply of said mixture in the form of a gas, provided upstream of said condenser.

3. The process according to claim 2, wherein said compressor comprises an upstream stage and a downstream stage, said auxiliary supply of said mixture being provided in said downstream stage.

4. The cooling process according to either claim 2 or 3, wherein an inlet for said mixture, in the form of a liquid, is provided in said loop at said liquid outlet of said storage tank.

5. The process according to either claim 2 or 3, wherein an outlet for said mixture is provided in said storage tank.

6. The process according to either claim 2 or 3, wherein an inlet for light components is provided in said storage tank.

7. The cooling process according to either claim 2 or 3, wherein a purge for volatile components is provided on said storage tank.

8. The process according to either claim 2 or 3, wherein an outlet for volatile components is provided on said storage tank, said outlet for volatile components being connected to a passage provided in said heat exchanger and serving to condense and supercool said volatile components before said volatile components are supplied as coolant into said heat exchanger.

9. The process according to claim 8, further comprising the step of expanding said volatile components in a control valve after said volatile components have passed through said passage serving to condense said volatile components and to supercool said volatile components and before said volatile components act as a coolant in said exchanger.

10. The process according to claim 9, further comprising the step of mixing flows of said mixture and said volatile components after their expansion and before entry into said heat exchanger as coolant.

11. The process according to claim 8, further comprising the step of removing a portion of said mixture and said volatile components after said step of supercooling in said heat exchanger for purposes of cooled storage.

12. The process according to either claim 2 or 3, further comprising the step of removing a part of said mixture at said liquid outlet of said storage tank.

13. The process according to claim 1, wherein said loop comprises, in succession, a compressor, a condenser, a storage tank having a liquid outlet, and a heat exchanger, and further including an auxiliary supply of said mixture, in the form of a liquid, at an inlet of said heat exchanger.

14. The process according to either claim 2 or 13, further comprising the step of supercooling said mixture in a passage provided in said heat exchanger at a position before said mixture enters said heat exchanger for causing said mixture to act as a coolant in said heat exchanger.

15. The process according to claim 14, further comprising the step of expanding said mixture in a control valve after said mixture has passed through said passage and before acting as a coolant.

16. The process according to either claim 2 or 13, further comprising the step of desuperheating said mixture superheated in said compressor by heat exchange with said mixture exiting said heat exchanger before entering said compressor.

17. In a process for recovering or fractionating a mixture present in a crude gas, said mixture primarily comprising butane and propane, by cooling said crude gas using a closed cooling loop; the improvement comprising employing said mixture as the coolant in a material consisting primarily of said closed cooling loop.

* * * * *